US005797567A

United States Patent [19]

Magnafici

[11] Patent Number: 5,797,567

[45] Date of Patent: Aug. 25, 1998

[54] EASY FILL LOCKING BAG HOLDER

[76] Inventor: Bill Magnafici, 115 W. Sunset Dr., Amboy, Ill. 61310-1167

[21] Appl. No.: 653,706

[22] Filed: May 23, 1996

[51] Int. Cl.[6] ..... A63B 55/04

[52] U.S. Cl. ..... 248/97; 248/95; 248/99; 248/101; 269/152

[58] Field of Search ..... 248/95, 97, 99, 248/101, 146, 176.1; 269/152

[56] References Cited

U.S. PATENT DOCUMENTS

| | | | |
|---|---|---|---|
| 1,281,680 | 10/1918 | Smith | 269/152 |
| 2,490,858 | 12/1949 | Deddo | 269/152 |
| 2,815,566 | 12/1957 | Hille | 248/176.1 X |
| 2,887,974 | 5/1959 | Weinfeld | 269/152 X |
| 3,603,542 | 9/1971 | Grille | 248/101 |
| 4,099,441 | 7/1978 | Landon | 248/176.1 X |
| 4,239,197 | 12/1980 | Olstad | 269/152 X |
| 4,339,099 | 7/1982 | Barton et al. | 248/101 |
| 4,362,295 | 12/1982 | Ford | 269/69 |
| 4,664,455 | 5/1987 | Greenhow | 248/95 X |
| 4,723,740 | 2/1988 | Courtmanche et al. | 248/95 |
| 4,934,636 | 6/1990 | Orlosky et al. | 248/95 |
| 5,169,101 | 12/1992 | Wenzel et al. | 248/95 X |
| 5,183,226 | 2/1993 | Brooks | 248/97 |
| 5,190,253 | 3/1993 | Sable | 248/97 |
| 5,222,702 | 6/1993 | Olmos | 248/95 |
| 5,350,142 | 9/1994 | Kurtzman et al. | 248/95 X |
| 5,458,301 | 10/1995 | Cournoyer | 248/95 |
| 5,513,823 | 5/1996 | Bresnahan | 248/95 X |
| 5,570,862 | 11/1996 | Nugent | 248/101 X |

*Primary Examiner*—Beth Aubrey
*Attorney, Agent, or Firm*—Michael I. Kroll

[57] ABSTRACT

A holder (10) for a zip lock bag (12) includes an assemblage (14), for supporting the zip lock bag (12) in a vertical opened position, so that articles (16) can be deposited into the zip lock bag (12) by two free hands (18) of a person.

11 Claims, 2 Drawing Sheets

EASY FILL LOCKING BAG HOLDER

BACKGROUND OF THE INVENTION

1. Field of the Invention

The instant invention relates generally to retaining devices and more specifically it relates to an easy fill locking bag holder.

2. Description of the Prior Art

Numerous retaining devices have been provided in prior art that are adapted to support and maintain various items in stationary safe conditions. While these units may be suitable for the particular purpose to which they address, they would not be as suitable for the purposes of the present invention as heretofore described.

SUMMARY OF THE INVENTION

A primary object of the present invention is to provide an easy fill locking bag holder that will overcome the shortcomings of the prior art devices.

Another object is to provide an easy fill locking bag holder that will support a locking bag in a vertical opened position, so that articles can be deposited into the locking bag by two free hands of a person.

An additional object is to provide an easy fill locking bag holder that is height and width adjustable to accommodate various sized locking bags, which will hold different types of articles therein.

A further object is to provide an easy fill locking bag holder that is simple and easy to use.

A still further object is to provide an easy fill locking bag holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
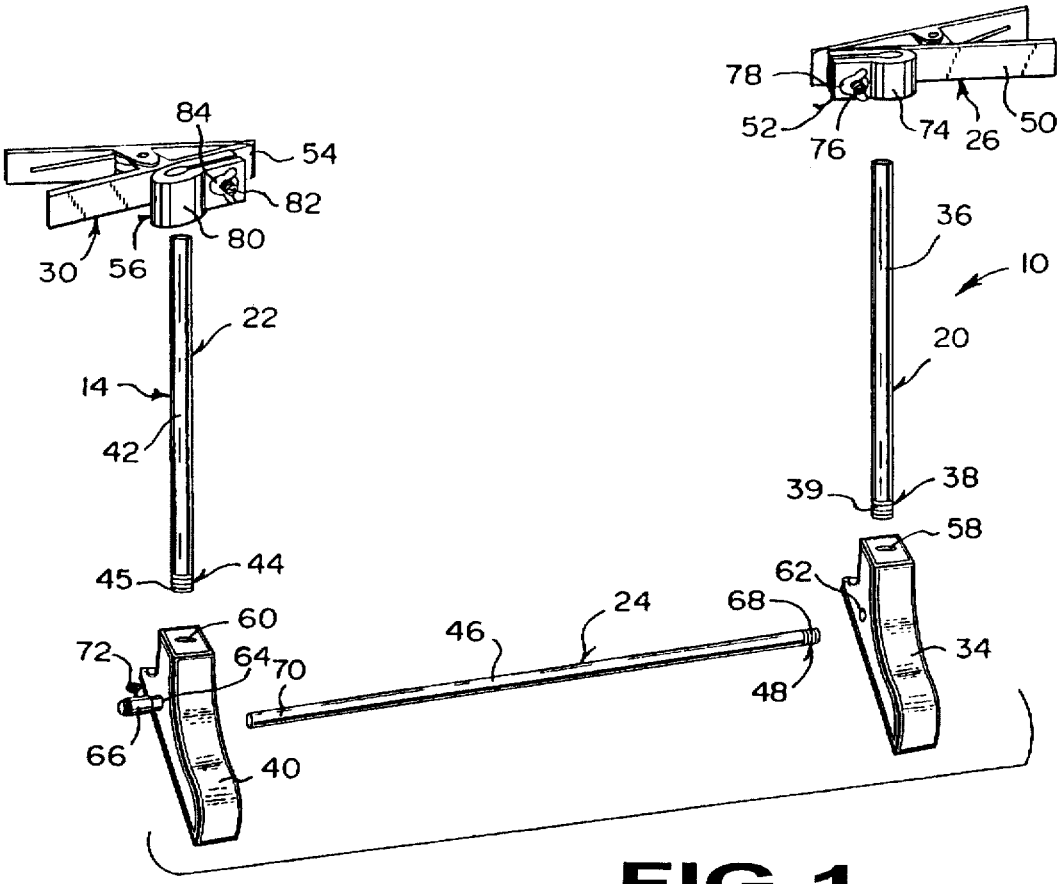
FIG. 1 is an exploded perspective view of the instant invention.
Figure 2:
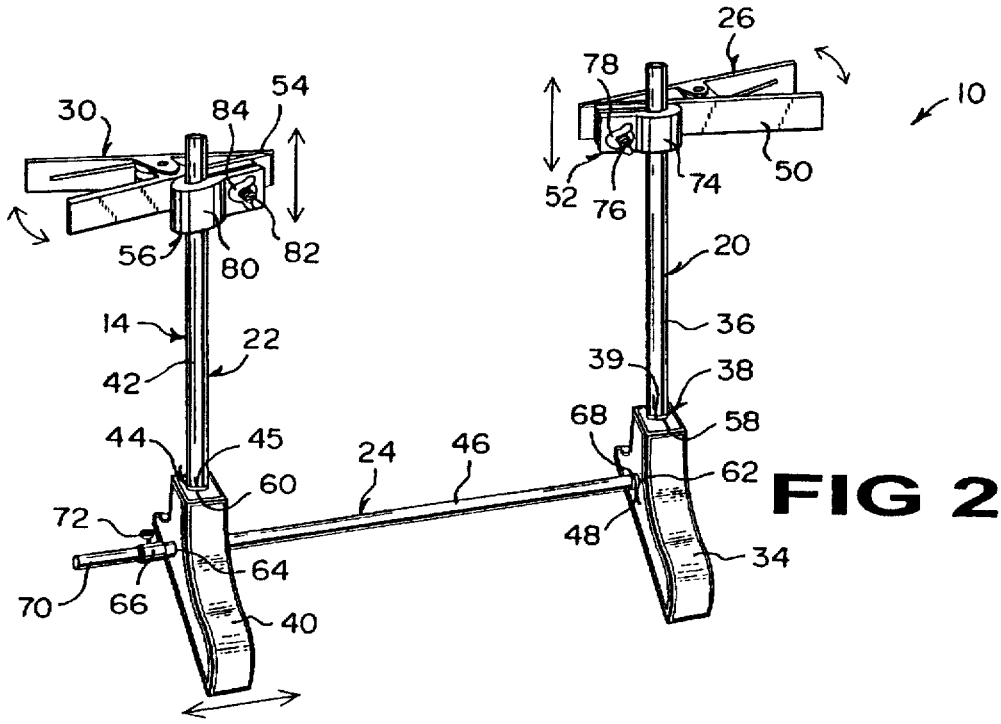
FIG. 2 is an assembled perspective view of the instant invention.
Figure 3:
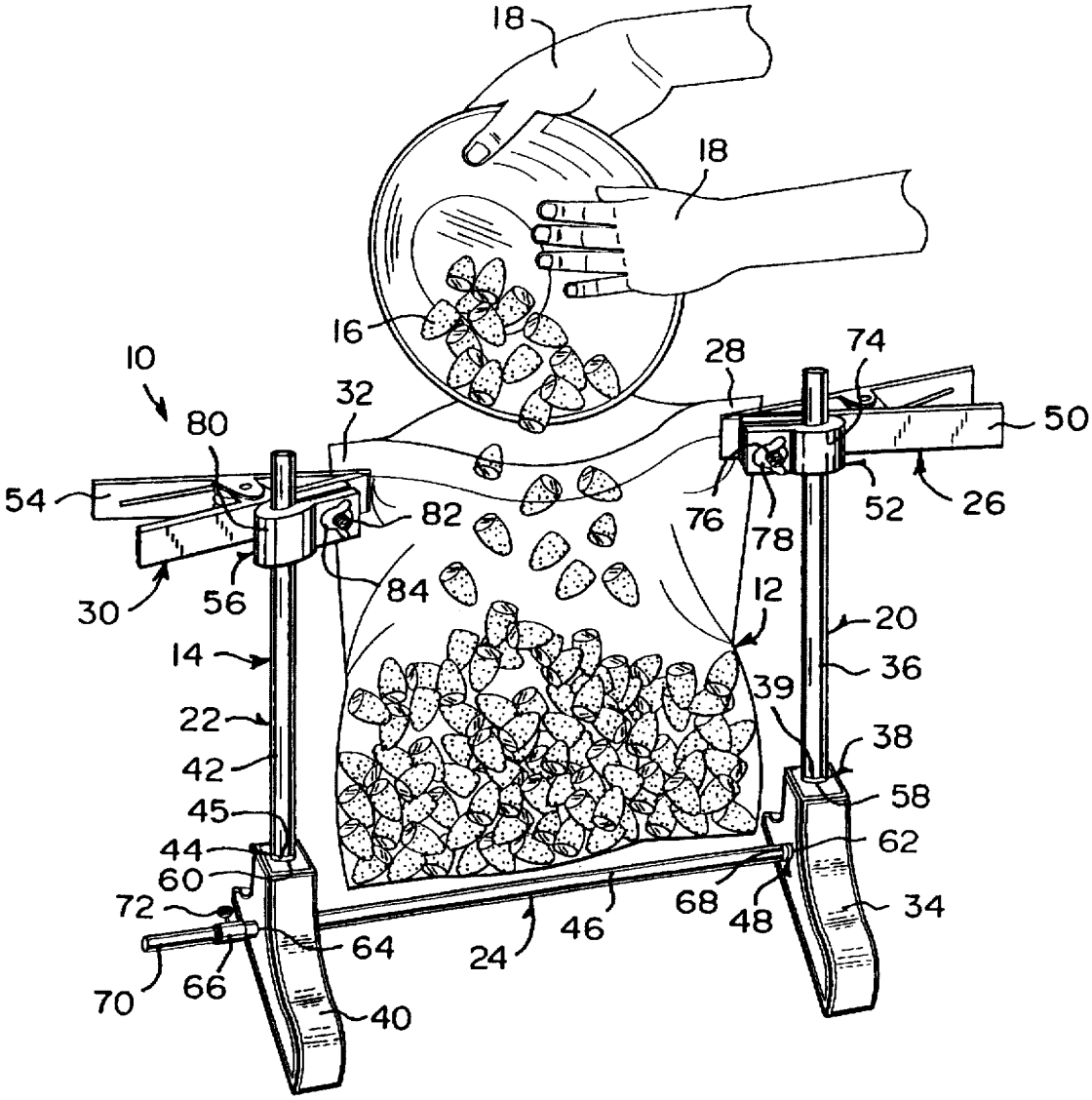
FIG. 3 is an assembled perspective view of the instant invention in use, showing a locking bag supported in a vertical opened position with food being deposited into the locking bag by two free hands of a person.

Turning now descriptively to the drawings, in which similar reference characters denote similar elements throughout the several views, FIGS. 1 through 3 illustrate a holder 10 for a locking bag 12, comprising an assemblage 14 for supporting the locking bag 12 in a vertical opened bag position, so that articles 16 can be deposited into the locking 12 by two free hands 18 of a person.

The supporting assemblage 14 includes a first stanchion assembly 20 and a second stanchion assembly 22. A crossbar 24 extends horizontally between lower ends of the first stanchion assembly 20 and the second stanchion assembly 22. A structure 26 on an upper end of the first stanchion assembly 20, is for engaging with a first upper corner 28 of the locking bag 12. A structure 30 on an upper end of the second stanchion assembly 22, is for engaging with a second upper corner 32 of the locking bag 12, so that the locking bag 12 can hang down in the vertical opened position.

The first stanchion assembly 20 consists of a first base member 34 to rest upon a flat horizontal surface. A first elongated post 36 is provided. A facility 38 is for attaching a lower end 39 of the first elongated post 36 to the first base member 34, so that the first elongated post 36 will extend up vertically.

The second stanchion assembly 22 comprises a second base member 40 to rest upon the flat horizontal surface. A second elongated post 42 is provided. A facility 44 is for attaching a lower end 45 of the second elongated post 42 to the second base member 40, so that the second elongated post 42 will extend up vertically.

The crossbar 24 includes an elongated rod 46. A structure 48 is for securing the elongated rod 46 in an adjustable manner between the lower ends of the first stanchion assembly 20 and the second stanchion assembly 22.

The first engaging structure 26 consists of a first spring clip 50. Device 52 is for affixing the first spring clip 50 transversely to the upper end of the first stanchion assembly 20 in an adjustable manner.

The second structure 30 comprises a second spring clip 54. Device 56 is for affixing the second spring clip 54 transversely to the upper end of the second stanchion assembly 22 in an adjustable manner.

The first attaching facility 38 includes the first base member 34 having a top threaded hole 58 therein. The lower end 39 of the first elongated post 36 is threaded, so that the lower end 39 can thread into the top threaded hole 58 in the first base member 34.

The second attaching facility 44 consists of the second base member 40 having a top threaded hole 60 therein. The lower end 45 of the second elongated post 42 is threaded, so that the lower end 45 can thread into the top threaded hole 60 in the second base member 40.

The securing structure 48 comprises the first base member 34 of the first stanchion assembly 20 having a side threaded hole 62 therein. The second base member 40 of the second stanchion assembly 22 has a side bore 64 therethrough. A sleeve 66 has an end inserted into the side bore 64. The elongated rod 46 has a first end 68 threaded. The first end 68 can thread into the side threaded hole 62 in the first base member 34. A second end 70 of the elongated rod 46 can adjustably slide fit through the side bore 64 in the second base member 40 and the sleeve 66. A setscrew 72 in the sleeve 66 can lock the elongated rod 66 in a stationary position.

The first affixing device 52 includes a first collar clamp 74 attached to the first spring clip 50. A threaded shank 76 is in the first collar clamp 74. A wing nut 78 is on the threaded shank 76, to tighten the first collar clamp 74.

The second affixing device 56 consists of a second collar clamp 80 attached to the second spring clip 54. A threaded shank 82 is in the second collar clamp 80. A wing nut 84 is on the threaded shank 82, to tighten the second collar clamp 80.

LIST OF REFERENCE NUMBERS

10 holder
12 locking bag
14 supporting assemblage of 10
16 article
18 free hand
20 first stanchion assembly of 14
22 second stanchion assembly of 14
24 crossbar of 14
26 first engaging structure of 14 on 20
28 first upper corner of 12
30 second engaging structure of 14 or 22
32 second upper corner of 12
34 first base member of 20
36 first elongated post of 20
38 first attaching facility of 20
39 threaded lower end on 36 of 38
40 second base member of 22
42 second elongated post of 22
44 second attaching facility of 22
45 threaded lower end on 42 of 44
46 elongated rod of 24
48 securing structure for 46
50 first spring clip of 26
52 first affixing device of 26
54 second spring clip of 30
56 second affixing device of 30
58 top threaded hole in 34 of 38
60 top threaded hole in 40 of 44
62 side threaded hole in 34 of 48
64 side bore in 40 of 48
66 sleeve of 48
68 threaded first end on 46 of 48
70 second end on 46
72 setscrew in 66 of 48
74 first collar clamp of 52
76 threaded shank in 74
78 wing nut on 76
80 second collar clamp of 56
82 threaded shank in 80
84 wing nut on 82

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters patent is set forth in the appended claims:

1. A holder for a locking bag comprising means for supporting the locking bag in a vertical opened position, so that articles can be deposited into the locking bag by two free hands of a person, wherein said supporting means includes:

a) a first stanchion assembly including:
  i) a first base member having a top to rest upon a flat horizontal surface;
  ii) a first elongated post having a lower end; and
  iii) first means for attaching the lower end of said first elongated post to said top of said first base member, so that said first elongated post will extend up vertically, said first attaching means including said first base member having a threaded hole in the top thereof and said first elongated post having the lower end threaded so that said lower end can thread into said top threaded hole in said first base member;

b) a second stanchion assembly having a lower end and an upper end;

c) a crossbar extending horizontally between lower ends of said first stanchion assembly and said second stanchion assembly;

d) means on an upper end of said first stanchion assembly, for engaging with a first upper corner of the locking bag, said first engaging means including:
  i) a first spring clip; and
  ii) means for affixing said first spring clip transversely to the upper end of said first stanchion assembly in an adjustable manner;
  and e) means on the upper end of said second stanchion assembly, for engaging with a second upper corner of the locking bag, so that the locking bag can hang down in the vertical opened position.

2. A holder for a locking bag as recited in claim 1, wherein said crossbar includes:

a) an elongated rod; and b) means for securing said elongated rod in an adjustable manner between the lower ends of said first stanchion assembly and said second stanchion assembly.

3. A holder for a zip lock bag as recited in claim 1, wherein said first affixing means includes:

a) a first collar clamp attached to said first spring clip;

b) a threaded shank in said first collar clamp; and c) a wing nut on said threaded shank to tighten said first collar clamp.

4. A holder for a zip lock bag as recited in claim 1, wherein said second stanchion assembly includes:

a) a second base member to rest upon a flat horizontal surface;

b) a second elongated post; and c) means for attaching a lower end of said second elongated post to said second base member, so that said second elongated post will extend up vertically.

5. A holder for a zip lock bag as recited in claim 4, wherein said crossbar includes:

a) an elongated rod; and b) means for securing said elongated rod in an adjustable manner between the lower ends of said first stanchion assembly and said second stanchion assembly.

6. A holder for a zip lock bag as recited in claim 5, wherein said second engaging means includes:

a) a second spring clip; and b) means for affixing said second spring clip transversely to the upper end of said second stanchion assembly in an adjustable manner.

7. A holder for a zip lock bag as recited in claim 4, wherein said second attaching means includes:

a) said second base member having a top threaded hole therein; and b) said lower end of said second elongated post being threaded, so that said lower end can thread into said top threaded hole in said second base member.

8. A holder for a zip lock bag as recited in claim 5, wherein said securing means includes:

a) said first stanchion assembly including said first base member having a side threaded hole therein;

b) said second stanchion assembly including said second base member having a side bore therethrough;

c) a sleeve having an end inserted into said side bore;

d) said elongated rod having a first end threaded, so that said first end can thread into said side threaded hole in said first base member, while a second end of said elongated rod can adjustably slide fit through said side bore in said second base member and said sleeve; and e) a setscrew in said sleeve can lock said elongated rod in a stationary position.

9. A holder for a zip lock bag as recited in claim 8, wherein said-first affixing means includes:

a) a first collar-clamp attached to said first spring clip;

b) a threaded shank in said first collar clamp; and c) a wing nut on said threaded shank to tighten said first collar clamp.

10. A holder for a zip lock bag as recited in claim 6, wherein said second affixing means includes:

a) a second collar clamp attached to said second spring clip;

b) a threaded shank in said second collar clamp; and c) a wing nut on said threaded shank to tighten said second collar clamp.

11. A holder for a locking bag comprising means for supporting the locking bag in a vertical opened position, so that articles can be deposited into the locking bag by two free hands of a person, wherein said supporting means includes:

A) a first stanchion assembly:

B) a second stanchion assembly:

C) a crossbar extending horizontally between lower ends of said first stanchion assembly and said second stanchion assembly, said crossbar including:

i) an elongated rod: and ii) means for securing said elongated rod in an adjustable manner between the lower ends of said first stanchion assembly and said second stanchion assembly, wherein said securing means includes:

a) said first stanchion assembly including a first base member having a side threaded hole therein;

b) said second stanchion assembly including a second base member having a side bore therethrough;

c) a sleeve having an end inserted into said side bore;

d) said elongated rod having a first end threaded, so that said first end can thread into said side threaded hole in said first base member, while a second end of said elongated rod can adjustably slide fit through said side bore in said second base member and said sleeve; and e) a setscrew in said sleeve which can lock said elongated rod in a stationary position;

D) means on an upper end of said first stanchion assembly, for engaging with a first upper corner of the locking bag; and E) means on an upper end of said second stanchion assembly, for engaging with a second upper corner of the locking bag, so that the zip lock bag can hang down in the vertical opened position.

* * * * *